United States Patent [19]

Moretti et al.

[11] 4,310,738

[45] Jan. 12, 1982

[54] MICROWAVE FLUID HEATING SYSTEM

[76] Inventors: Michael Moretti, West Islip; Dennis McCann, Babylon, both of N.Y.

[21] Appl. No.: 120,003

[22] Filed: Feb. 8, 1980

[51] Int. Cl.[3] ..... H05B 6/78

[52] U.S. Cl. ..... 219/10.55 A; 219/10.55 R; 219/299; 219/305; 165/139; 122/235 K

[58] Field of Search ..... 219/10.55 R, 10.53 A, 219/10.55 F, 10.51, 10.65, 299, 291, 302, 303, 304, 305, 378; 122/4 A, 13 A, 235 K; 165/139, 164; 126/344, 392

[56] References Cited

U.S. PATENT DOCUMENTS

| | | | |
|---|---|---|---|
| 2,188,625 | 1/1940 | Dufour et al. | 219/291 |
| 3,083,528 | 4/1963 | Brown | 219/10.55 R |
| 3,582,597 | 6/1971 | Smith | 219/10.55 A |
| 3,737,608 | 6/1973 | Nagao et al. | 219/10.55 R |
| 3,812,315 | 5/1974 | Martin | 219/10.55 R |
| 3,884,213 | 5/1975 | Smith | 219/10.55 M X |
| 3,968,346 | 7/1976 | Cooksley | 219/305 |
| 4,114,011 | 9/1978 | Stubbs | 219/10.55 R X |
| 4,152,567 | 5/1979 | Mayfield | 219/10.55 A |

FOREIGN PATENT DOCUMENTS

| | | | |
|---|---|---|---|
| 47-42581 | 10/1972 | Japan | 219/10.55 R |

*Primary Examiner*—Gene Z. Rubinson
*Assistant Examiner*—Philip H. Leung
*Attorney, Agent, or Firm*—Richard L. Miller

[57] ABSTRACT

A microwave heating system utilizing a magnetron for generating the microwaves. The microwaves are sent to a diffuser which spreads the microwaves in an upper chamber of a housing from where they can bounce off the metal walls of the upper chamber and pass through a clear plastic material into a lower chamber. A fluid passes through a circuitous path in the lower chamber and is heated by means of the microwaves.

6 Claims, 2 Drawing Figures

MICROWAVE FLUID HEATING SYSTEM

BACKGROUND OF THE INVENTION

This invention deals with heating systems, and more particularly to a microwave heating system utilizing a magnetron as the source of microwaves.

With a continuously increasing shortage in energy sources, there is a constant need for improved heating systems which can make better use of the energy source and provide a more efficient operating device. Many heating systems utilize an energy source which heats up water or other fluid and utilizes the fluid as a heat conveying substance. The fluid can either be utilized directly as in a hot water or home heating system, or alternately it can be sent to a further heat exchanger where the heat is extracted from the fluid and supplied to a further medium. However in most cases the heating system is initially utilized to heat up a fluid which serves as the heat transporting medium.

The use of microwaves for heating ovens has been found extremely effective. Such microwave ovens cook food by using short radio waves that penetrate the food and make its molecules vibrate. Friction among the moving molecules produces heat, which cooks the food. However, it is known that microwaves pass through many types of substances, such as glass, paper, and most kinds of china without heating them. Therefore, containers made of those materials may be used to hold the food in a microwave oven.

Additionally,, the walls of the microwave oven are usually made of metal since microwaves bounce off the metal without warming it.

The usual microwave ovens utilize an electronic vacuum tube, called a magnetron, in order to produce the microwaves. In many ovens, the microwaves travel through a metal tube such as a waveguide to a diffuser, such as a fan. The moving blades of the diffuser scatter the microwaves into the oven which has metal walls. The waves bounce from wall to wall until they enter food in the oven.

Although microwaves have generally been successfully utilized to provide heating of food, thus far, microwaves have not generally been commercially utilized as a source of heat for a fluid heating system.

SUMMARY OF THE INVENTION

Accordingly, it is an object of the present invention to provide a microwave heating system.

A further object of the present invention is to provide a microwave heating system using a magnetron source.

Another object of the present invention is to provide a heating system having a housing which is uneffected by microwaves while using microwaves to heat to fluid passing through the housing.

Still a further object of the present invention is to provide a microwave heating system using a flowing fluid at the heat transmitting medium.

Yet another object of the present invention is to provide a microwave heating system having a housing with a fluid flowing therethrough in a circuitous path, whereby the the fluid will be heated by the microwaves.

Still a further object of the present invention is to provide a microwave heating system having a housing containing two circuitous paths through which fluid will flow wherein one path is restricted so that the fluid will remain therein for a greater length of time and thereby become hotter.

Briefly, in accordance with the present invention, there is provided a microwave heating system, a housing having an upper dispersing chamber and a lower heating chamber. A magnetron for generating microwaves is located adjacent the housing. A diffuser in the top of the housing receives the microwaves through a waveguide and spreads the microwaves into the upper chamber where they bounce off the walls of the upper chamber and ultimately pass into the lower chamber. An inlet is provided in the lower chamber which provides a fluid to the lower chamber. The fluid passes through a circuitous path in the lower chamber where it is heated by the microwaves. An outlet coupled to the lower chamber removes the heated fluid from the lower chamber.

The foregoing objects, features and advantages of the invention will, in part, be pointed out with particularity and will, in part, become obvious from the following more detailed description of the invention, taken in conjunction with the accompanying drawing, which forms an integral part thereof.

BRIEF DESCRIPTION OF THE DRAWING

In the drawings.

In the various figures of the drawing, like reference characters designate like parts.

DESCRIPTION OF THE PREFERRED EMBODIMENTS

Figure 1:
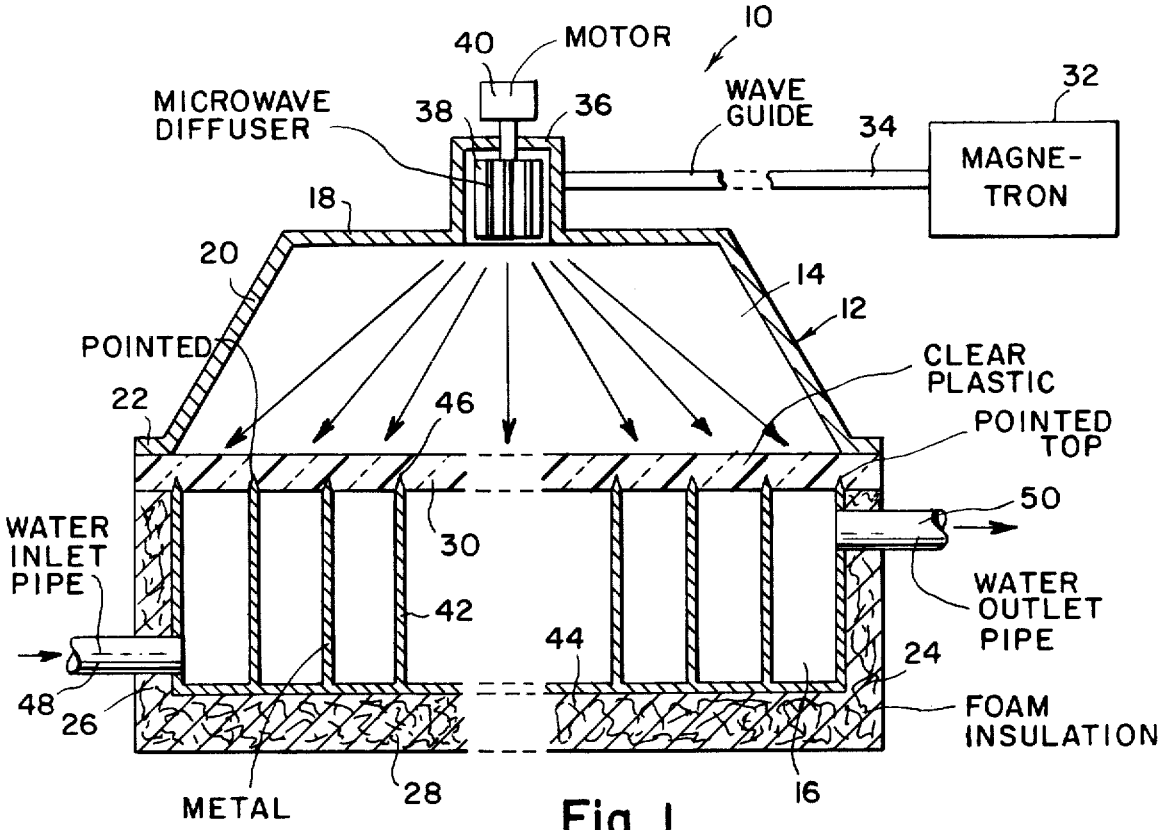
FIG. 1 is a side sectional view showing the microwave heating system of the present invention.

Referring now to FIG. 1, the microwave heating system of the present invention is shown generally at 10 and includes a housing 12 having an upper chamber 14 and a lower chamber 16. The upper chamber has a top wall 18, and outwardly flared side walls 20 which terminate in a bottom shoulder 22 which rests over the lower chamber. The lower chamber includes the side walls 24 and 26 and the bottom wall 28.

The upper and lower chambers are separated by means of a sheet of clear plastic material 30. The upper chamber is typically formed of a metal material and the lower chamber has foam insulation material surrounding its outside. It is understood, that a further outer casing could be included surrounding the lower chamber.

A magnetron 32 is located in a position adjacent to the housing and is interconnected to the housing by means of a waveguide 34. At the upper part of the housing, and located within an upper extension 36 of the upper chamber 14, is placed a microwave diffuser 38 which is driven by means of a motor 40.

Located within the lower chamber are a series of metal walls 42 which extend from a bottom wall 44 and terminate by being imbedded in the clear plastic sheet 30. The upper ends of the baffle walls 42 have pointed tips 46 which facilitate insertion into the plastic material to make a good seal and also prevent reflection off their tops by means of the microwaves coming downward from the diffuser.

The baffle walls 42 form a circuitous path for a fluid passing through the lower chamber. The fluid enters from an inlet pipe 48 and exits after it is heated from the outlet pipe 50.

Figure 2:
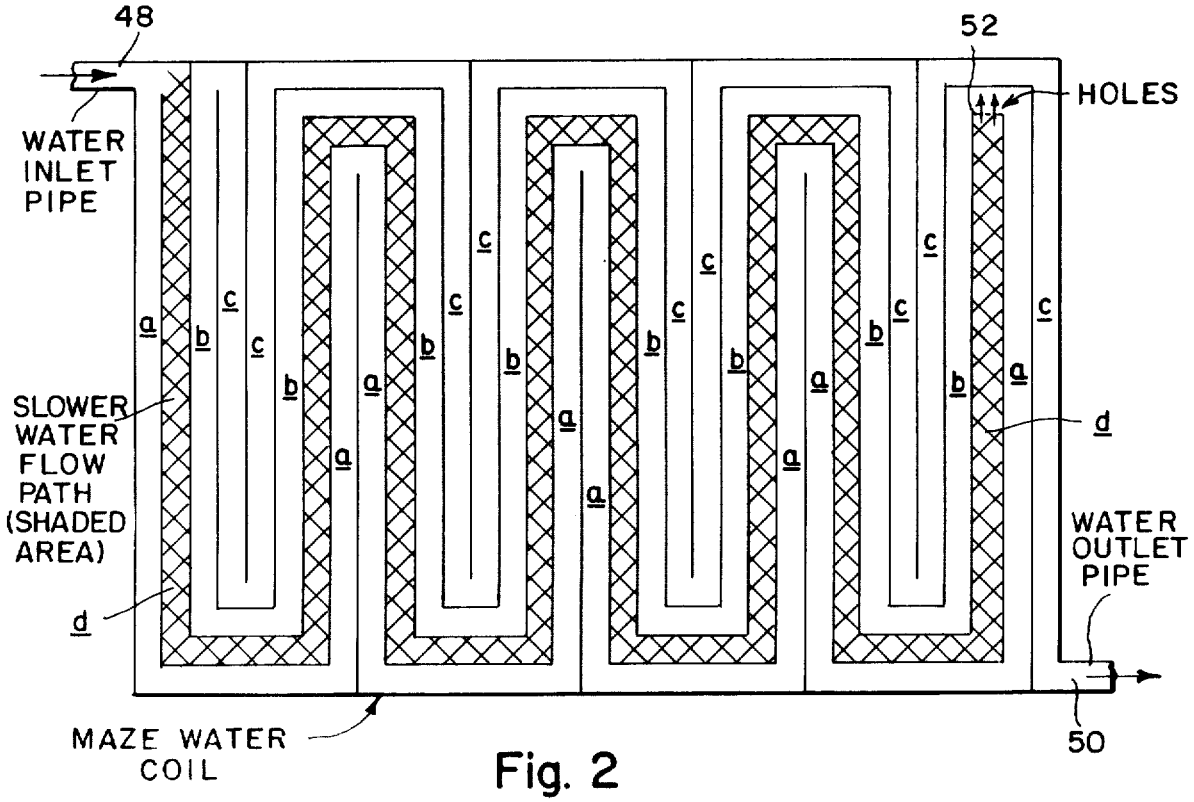
FIG. 2 is a schematic view of a circuitous heating path for use with the heating system of FIG. 1.

The particular circuitous path shown, by way of example, can best be described with respect to FIG. 2. It is noted that the fluid enters at the inlet 42 and passes through the outer paths designated by the letter a. Upon reaching the right most extreme edge, the path now flows back in an interleaved fashion along the paths designated by the letter b. When the fluid now reaches the left most part, it now returns towards the right, this time along the paths designated by the letter c. From the path c, the water continues and flows outward through the outlet pipe 50.

It will be noted, therefore, that the circuitous path is an interleaved serpentined path which is provided. This gives the fluid an opportunity to flow back and forth within the chamber and receive the microwaves.

In addition to the heretofore described circuitous path, a second circuitous path is also provided, and is shown as the path d which is highlighted by means of the cross sectioned lines. It will be noted that this path receives the fluid from the inlet and discharges the fluid so that it will ultimately also flow through the outlet pipe. However, it is provided with a restricting means so that the water will flow slower through this path and have an opportunity to be retained within the heating chamber for a greater length of time so as to become hotter than the fluid in the outer path. In the particular arrangement shown, the restriction is provided at the end 52 of the path d where restricted holes are provided so that the flow of the fluid out from this pipe will be slow. However, other types of restrictions can be utilized, such as for example using a narrower pipe, or such other restricting means.

It should further be understood, that the particular circuitous arrangement shown is only by way of example and other types of arrangements could similarly be used. The main purpose is to provide some type of a coiling arrangement so that the fluid will flow slowly enough through the lower chamber so as to be heated up by means of the microwaves.

In operation, the magnetron generates the microwaves which are sent through the waveguide to the diffuser. The diffuser scatters the microwaves into the upper chamber where they disperse throughout the upper chamber. Since the upper chamber is made of metal material, it is uneffected and it is not heated by means of the microwaves. However, the waves bounce from wall to wall in the upper chamber until they finally enter into the lower chamber through the clear plastic material.

It should be understood that the plastic material is also uneffected and unheated by means of the microwaves. The microwaves will then enter the lower chamber. Again, the metal baffle walls will not be heated but will only serve as a further method of bouncing the waves off the walls. Therefore, the only part that will actually be heated will be the fluid passing through the lower chamber. Such fluid will absorb the microwaves and the microwaves will cause the molecules within the fluid to vibrate so that the friction among the moving molecules in the fluid will produce heat. As a result, the fluid passing in the lower chamber will become heated.

The fluid passing through the slower restricted chamber will be heated to a greater extent. As a result, it is possible to obtain fluids at two temperature levels from the chamber. It is also understood that other circuitous paths could be provided so that different levels of temperatures can be obtained as desired.

Although numerous types of fluids can be utilized such as oil, water, etc., it has been found that a suitable fluid for this device is water and such water provides an effective and efficient microwave heating system.

Although particular types of materials have been mentioned, it is understood that substitutions of these materials can also be utilized so long as they carry out the features of the invention.

There has been disclosed heretofore the best embodiment of the invention presently contemplated. However, it is to be understood that various changes and modifications may be made thereto without departing from the spirit of the invention.

We claim:

1. A microwave heating system, comprising:

a housing having an upper dispersing chamber and a lower heating chamber;

a magnetron for generating microwaves;

a waveguide coupled to the magnetron for transmitting microwaves therefrom;

a diffuser receiving the microwaves through the waveguide and spreading them into the upper chamber from where they cam pass into the lower chamber;

a sheet of clear plastic material separating the upper and lower chambers;

a plurality of upright metal baffle walls extending from the bottom of said chamber to said sheet of plastic and having pointed top edges which are embedded into the sheet of plastic, said metal baffle walls in combination with the sheet of plastic and the bottom of the lower chamber defining an enclosed main circuitous path occupying the entire lower chamber, said circuitous path being an interleaved serpentined path;

inlet means coupled to the main circuitous path in the lower chamber for providing a fluid into the main circuitous path where it will be directly heated by the microwaves; and outlet means coupled to the main circuitous path in the lower chamber for removing the heated fluid;

whereby the fluid flows circuitously from the inlet end to the outlet end circuitously back to the inlet end, and then circuitously back to the outlet end again.

2. A microwave heating system as in claim 1, wherein said diffuser is positioned at the top of said upper chamber, and wherein the walls of said upper chamber are flared outwardly from the top of the upper chamber downward toward the lower chamber.

3. A microwave heating system as in claim 1, wherein said upper chamber is formed of metal material which aides in the scattering of the microwaves into the lower chamber.

4. A mirowave heating system as in claim 1, and further comprising foam insulation formed about the lower chamber to retain the heat therein.

5. A microwave heating system, comprising:

a housing having an upper dispersing chamber and a lower heating chamber;

a magnetron for generating microwaves;

a waveguide coupled to the magnetron for transmitting microwaves therefrom;

a diffuser receiving the microwaves through the waveguide and spreading them into the upper chamber from where they can pass into the lower chamber;

a sheet of clear plastic material separating the upper and lower chambers;

a plurality of upright metal baffle walls extending from the bottom of said chamber to said sheet of plastic and having pointed top edges which are embedded into the sheet of plastic, said metal baffle walls in combination with the sheet of plastic and the bottom of the lower chamber defining an enclosed main circuitous path occupying the entire lower chamber;

inlet means coupled to the main circuitous path in the lower chamber for providing a fluid into the main circuitous path where it will be directly heated by the microwaves;

outlet means coupled to the main circuitous path in the lower chamber for removing the heated fluid; and a secondary circuitous passageway formed within said main circuitous path, said secondary passageway including means for retaining the flow of fluid therethrough so that the fluid in the secondary passageway will flow slower through the lower chamber and will thereby become hotter.

6. A microwave heating system as in claim 5, wherein the secondary passageway is coupled to said inlet means for receiving fluid therein, and has a restricted outlet for delaying the fluid passing therethrough.

* * * * *